United States Patent [19]

Curtiss

[11] 4,174,840

[45] Nov. 20, 1979

[54] WEIGHT CONTROL GAME APPARATUS

[76] Inventor: Richard A. Curtiss, 207 Carlton Club Dr., Piscataway, N.J. 08854

[21] Appl. No.: 880,976

[22] Filed: Feb. 24, 1978

[51] Int. Cl.[2] ..... A63F 3/00

[52] U.S. Cl. ..... 273/248; 273/243

[58] Field of Search ..... 273/243, 246, 247, 248, 273/287, 284; 35/8 R

[56] References Cited

U.S. PATENT DOCUMENTS

| | | | |
|---|---|---|---|
| 2,823,919 | 2/1958 | Scruggs | 273/246 |
| 3,603,591 | 9/1971 | Shoptaugh | 273/264 |
| 3,899,176 | 8/1975 | Gregan | 273/287 |
| 3,899,177 | 8/1975 | Sells | 273/246 X |
| 4,010,956 | 3/1977 | Zyla et al. | 273/246 |

*Primary Examiner*—Richard C. Pinkham
*Assistant Examiner*—Scott L. Brown
*Attorney, Agent, or Firm*—Abraham Wilson

[57] ABSTRACT

A game emphasizing the relationship between food consumption and exercise in weight control includes a game board for each player with a first series of playing positions representing calories gained and a second series of playing positions representing calories lost. A player draws a card from a pack of game cards and places it in an area in front of the word "EAT" printed on a portion of the game board. If the card drawn has a "F" printed on its face, the word "FEAT" is spelled out. Otherwise the word "EAT" remains. Dice are then thrown by the player. If the word "EAT" remains, by reference to a food portion of a chart printed on the game board, the dice count is related to a corresponding number of moves taken along the first series of playing positions. If the work "FEAT" has been spelled out, by reference to a feat portion of the chart, the dice count is related to a number of moves along the second series of playing positions. If the second finishing position is reached before the first finishing position, weight has been lost by a player. Otherwise, weight has been gained by the player. The player having lost the greatest amount of weight is the winner.

12 Claims, 1 Drawing Figure

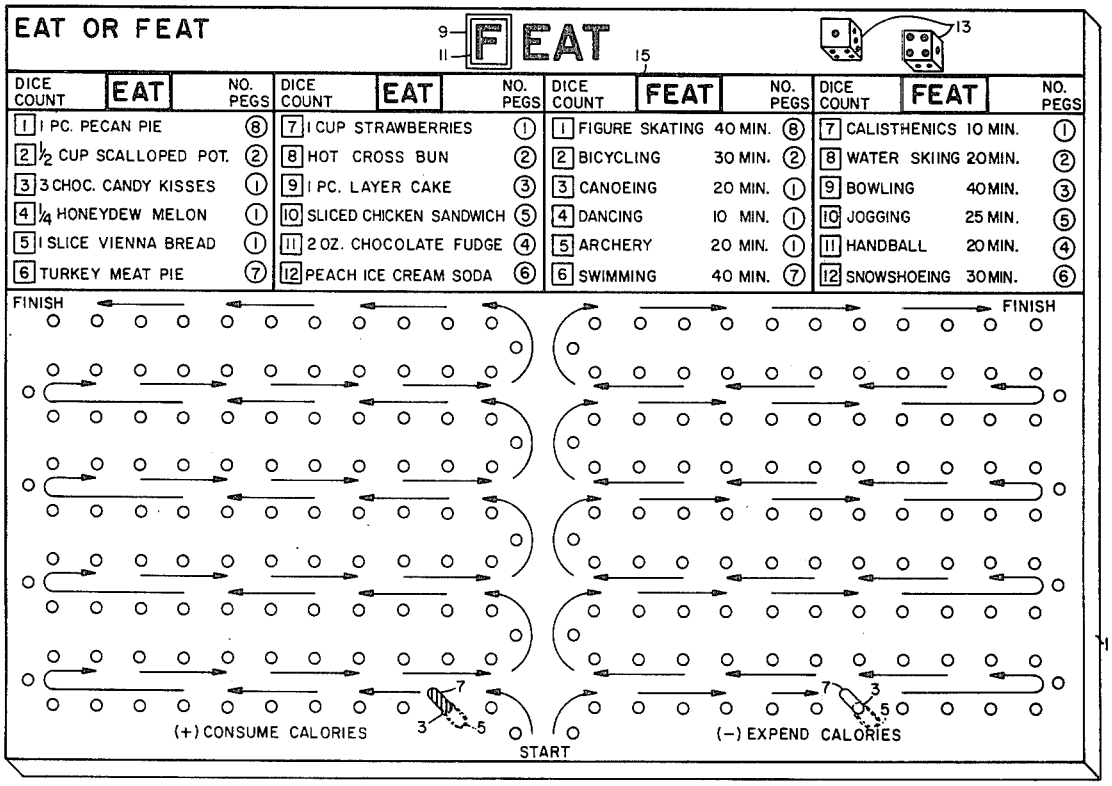

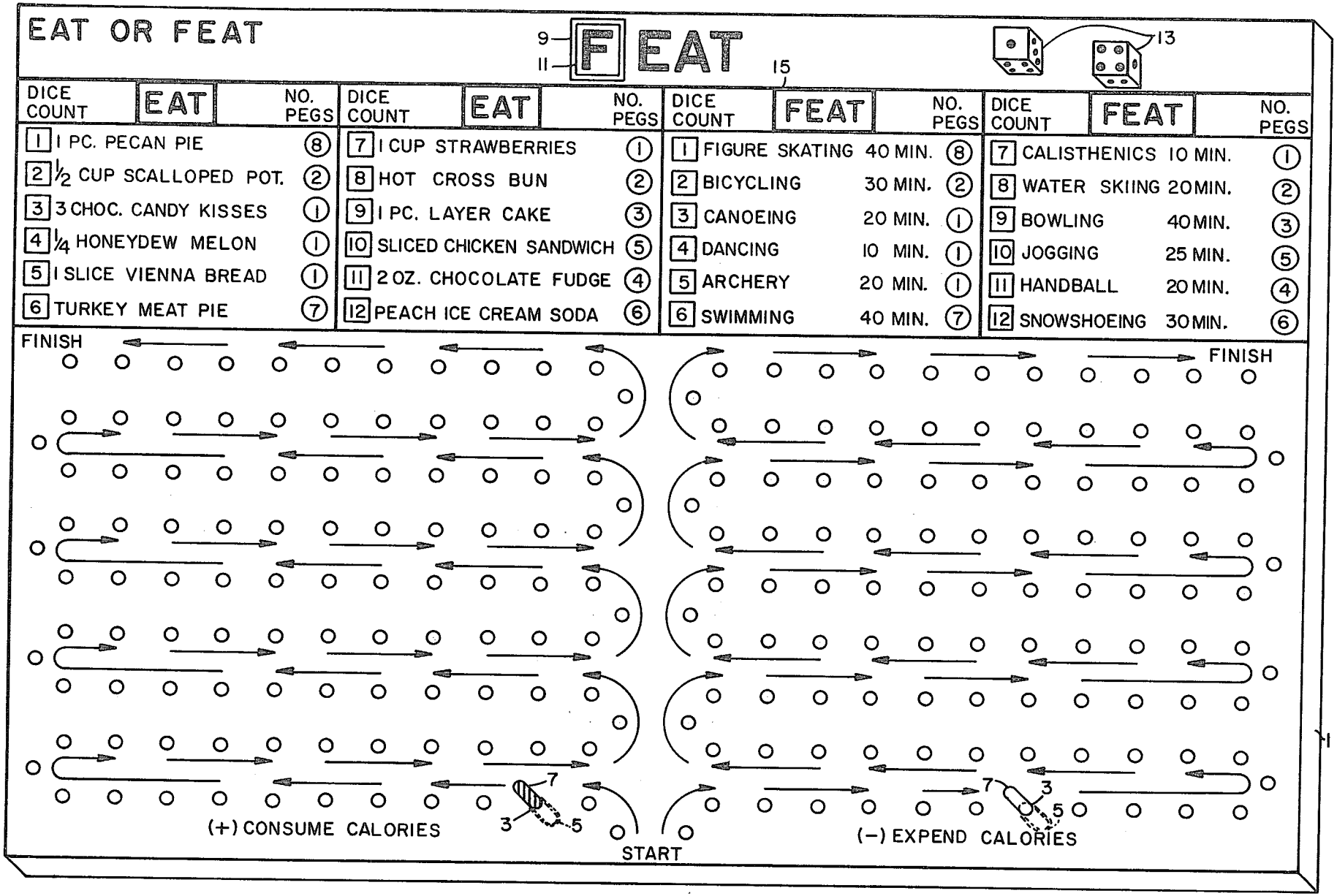
EAT OR FEAT
EAT
FEAT
9
11
13
15
7
DICE COUNT
NO. PEGS
1 1 PC. PECAN PIE 8
2 1/2 CUP SCALLOPED POT. 2
3 3 CHOC. CANDY KISSES 1
4 1/4 HONEYDEW MELON 1
5 1 SLICE VIENNA BREAD 1
6 TURKEY MEAT PIE 7
7 1 CUP STRAWBERRIES 1
8 HOT CROSS BUN 2
9 1 PC. LAYER CAKE 3
10 SLICED CHICKEN SANDWICH 5
11 2 OZ. CHOCOLATE FUDGE 4
12 PEACH ICE CREAM SODA 6
1 FIGURE SKATING 40 MIN. 8
2 BICYCLING 30 MIN. 2
3 CANOEING 20 MIN. 1
4 DANCING 10 MIN. 1
5 ARCHERY 20 MIN. 1
6 SWIMMING 40 MIN. 7
7 CALISTHENICS 10 MIN. 1
8 WATER SKIING 20 MIN. 2
9 BOWLING 40 MIN. 3
10 JOGGING 25 MIN. 5
11 HANDBALL 20 MIN. 4
12 SNOWSHOEING 30 MIN. 6
FINISH
START
(+) CONSUME CALORIES
(−) EXPEND CALORIES
3
5
7

WEIGHT CONTROL GAME APPARATUS

BACKGROUND OF THE INVENTION

The present invention relates to the field of board games. Presently much attention has been directed to weight control. In most weight control programs the relation between the food consumption and exercise activity is a vital element. Many board games are known which provide instruction in some field of endeavor, e.g., business, in an entertaining manner. The present board game, which may be played by one or more players, is directed at emphasizing the relationship between food consumption and exercise activity in a weight control program.

SUMMARY OF THE INVENTION

The present weight control game apparatus includes a gameboard having a plurality of consecutive playing positions between starting and finishing positions and chance selection means for enabling a player to make a chance selection of one of a variety of foods and exercise activities. Each of the foods and exercise activities has a number of playing position moves corresponding at least approximately to its caloric value. A first marker is provided to be moved between the playing positions when a food is selected. A second marker is provided to be moved between playing positions when an exercise activity is selected. The relative positions of the markers determines whether the player has lost or gained weight and the amount of weight lost or gained.

BRIEF DESCRIPTION OF THE DRAWING

The sole FIGURE of the Drawing shows a gameboard and associate apparatus comprising the preferred embodiment of the present weight control game.

DETAILED DESCRIPTION OF THE DRAWING

The preferred embodiment of the present weight control game includes a gameboard 1 for each player. Gameboard 1 is partitioned into an "eat" side, labelled "(+) CONSUME CALORIES", corresponding to the consumption of foods and a "feat" side, labelled "(−) EXPEND CALORIES", corresponding to the performance of exercise activities or feats. Each side has a series of playing positions 3 following a generally serpentine path between starting and finishing positions. At each playing position 3, an aperture 5 is formed partially through the gameboard 1 to receive one end of a peg 7 utilized as a playing position maker. Desirably, pegs having two ends of the same shape but of different colors, e.g., white and red, are provided. A peg is inserted with one color up on the "eat" side and another peg is inserted with the other color up on the "feat" side as playing position markers. The word "EAT" is printed in bold face letters on the top portion of gameboard 1. An area 9 in front of the word "EAT" is provided for the placement of a card 11 drawn by a player from a pack (not shown) accompanying the game. The pack of cards contains two kinds if cards, desirably of equal number. The first kind of card has the letter "F" printed in bold face on its playing face. The other kind of card (not shown) has a symbol or picture such as, for example, a picture of a food, a relatively obese person eating or the like, associated with food consumption printed on its playing face. As will be explained later, when a card is drawn from the pack, it is placed laying face up in area 9. If a card with an "F" has been drawn, the word "FEAT" is spelled out (as is shown in the FIGURE). Otherwise, thw word "EAT" remains A pair of dice 13 is also provided. A chart 15 printed on gameboard 1 relates the number determined by a throw of the dice into a number of moves on either the "eat" side or "feat" side. An "EAT" portion of chart 15 relates the dice count to a respective food. Each food has a number of moves (i.e., "NO.PEGS") along the series of playing positions on the "eat" side of gameboard 1 corresponding to the caloric value associated with it. A "FEAT" portion of chart 15 relates the dice count to a respective feat exercise activity. Each feat exercise activity has a number of moves along the series of playing positions on the "feat" side of gameboard 1 corresponding to the caloric value associated with it. A move between two successive playing positions represents a predetermined number of calories, e.g. approximately 60.

An examination of both sides of chart 15 will reveal that for dice counts between 1 and 6 there are 4 relatively low numbers of moves, i.e., 2,1, 1 and 1 for dice counts 2, 3, 4 and 5, respectively, and two relatively high numbers of moves, i.e., 8 and 7 for dice counts 1 and 6, respectively, while for dice counts between 7 and 12 there is a linear or uniform distribution of numbers of moves between 1 and 6 respectively. This feature, in conjunction with the rules of the game permitting a player to throw, at his option, either one die or two dice, adds an element of strategy to the present weight control game as will later be explained.

The present weight control game may be appropriately named "EAT or FEAT" for reasons as will clear from the following description of how it is played. The game may be played by one or more players. To initiate the game, a gameboard 1 is distributed to each player and the cards are shuffled and placed playing face down in a draw stack at some convenient location between the players. If there be more than one player, the players take turns in throwing dice 13 to determine the order of play. The player throwing the highest dice count is first in the order of play.

The player whose turn it is, draws a card from the top of the draw stack and places it face up in card area 9 on his gameboard 1. If the card he has drawn has an "F" printed in its playing face, the word "FEAT" is spelled out on game board 1. Otherwise the word "EAT" will remain. The player then at his option throws either one die or two dice. (The purpose of the election of how many dice to throw will be explained below.) Assuming that the word "EAT" remains spelled out on game board 1, the player refers to the "EAT" portion of chart 15 to convert the dice count to a number of moves along the series of playing positions on the "eat" side of gameboard 1. For example, assuming that the player has thrown two dice obtaining a total dice count of 8, by reference to the "eat" portion of the chart the player is informed that a dice count of 8 corresponds to a hot cross bun with two moves associated with it. As a result, for this turn, the player moves a peg 7 two positions from the starting position on the "eat" side and inserts it with its colored (e.g., red) end up. This move corresponds to a consumption of calories approximately proportional to the number of calories associated with a hot cross bun. Had the player obtained a dice count of 12, he would have had to move position marker peg 7 six positions from the starting position on the "eat" side corresponding to the consumption of peach ice cream soda which, by comparison, has approximately three times as many calories as does a hot cross bun. When a player's turn is finished he places the card he has drawn in a discard pile. (The discard pile may be shuffled in a long game when all of the cards have been drawn from the draw stack and placed back on the draw stack.) The other players now take their turns in the same manner.

Assume now that the player during his next turn does not draw a card with "F" printed on its playing face. As a result, the word "EAT" will remain spelled out on his gameboard 1. Since during the player's last turn, he moved two playing positions on the "eat" side corresponding to the consumption of a hot cross bun, to at least neutralize his previous weight gain, he must move at least two playing positions on the "feat" side of gameboard 1. Assuming that the player now rolls one die rather than two dice and that the result is a dice count of 6, by reference to the "feat" side of chart 15 the player is instructed to move a position marker peg 7 seven playing positions 3 from the starting position on the "feat" side corresponding to a feat activity of swimming 40 minutes. Thus, at the end of two turns the player has lost weight. Furthermore the player will note that the consumption of a hot cross bun has been more than compensated for by swimming for 40 minutes.

The game continues in the aforesaid manner until one player after another reaches the finish position on either the "eat" or "feat" side of his game board 1. The player having the greatest weight loss or, if no player has lost weight, the least weight gain, is the winner of the game. If a player has reached the finish position of the "feat" side of his gameboard 1, he computes the total weight lost during the game by counting the number of remaining playing positions between the peg and the finishing position on the "eat" side of his gameboard 1 and making reference to a playing position versus weight table, such as shown below, provided with the game. If a player has reached the finish position of the "eat" side of his game board, he computes the total weight gained during the game by counting the number of remaining playing positions between the peg and the finishing position on the "feat" side of his gameboard 1 and making reference to the playing positions versus weight table.

| WEIGHT GAIN OR LOSS | | | | | |
|---|---|---|---|---|---|
| 0-5 | PLAYING POSITIONS | = | 1 | OUNCE | |
| 6-10 | " | = | 2 | " | |
| 11-15 | " | = | 3 | " | |
| 16-20 | " | = | 4 | " | |
| 21-25 | " | = | 5 | " | |
| 26-30 | " | = | 6 | " | |
| 31-35 | " | = | 7 | " | |
| 36-40 | " | = | 8 | " | (½ Lb.) |
| 41-45 | " | = | 9 | " | |
| 46-50 | " | = | 10 | " | |
| 51-55 | " | = | 11 | " | |
| 56-60 | " | = | 12 | " | |
| 61-65 | " | = | 13 | " | |
| 66-70 | " | = | 14 | " | |
| 71-75 | " | = | 15 | " | |
| 76-80 | " | = | 16 | " | (1 Lb.) |

As earlier mentioned, the distribution of calorie values as a function of dice count of both portions of chart 15 in conjunction with the rules of the present weight control game allowing a player to throw either one die or two dice at his option adds an element of strategy to the present weight control game. To understand this, noting that a dice count of 1 can occur only when one die is thrown, dice counts between 2 and 6 can occur either when one die or two dice are thrown and dice counts between 7 and 12 can occur only when two dice are thrown, the following odds can be calculated:

| Number of Dice | Number of Possible Moves | Odds |
|---|---|---|
| 1 | 7 or 8 (maximum) | 2 out of 6 chances |
| 1 | 3,4,5 or 6 not possible | — |
| 1 | 1 or 2 | 4 out of 6 chances |
| 2 | 8 not possible | — |
| 2 | 3,4,5 6 or 7 | 9 out of 20 chances |
| 2 | 1 or 2 | 11 out of 20 chances |

The above table illustrates advantages and disadvantages of throwing either one die or two dice at each of a player's turn. For example, assume a player has drawn a card such that the word "EAT" remains on gameboard 1. In this situation, it is advantageous for the player to minimize the number of moves on the "eat" side of gameboard 1. To this end, the player may decide to throw only one die because then the odds are 4 to 6 (i.e., a 66% chance) of getting only 1 or 2 moves (for dice counts 2,3,4 and 5.) However, this decision should be considered against the 2 to 6 odds, (i.e., a 33% chance) of getting 7 or 8 moves (for dice counts of 1 and 6) when only one die is thrown. Therefore, it may be better for the player to throw two dice with only 11 to 20 odds, (i.e., almost a 50% chance) of getting 1 or 2 moves and with a relatively small likelihood of getting 7 moves and no likelihood of getting 8 moves.

During play it may be desirable to utilize two pegs 7 on each side of game board 1 to keep track of the playing positions. In this case, on each side of gameboard 1 a front peg is utilized to indicate the present playing position before the dice (or die) are thrown and a back peg is utilized to indicate the last playing position before the dice (or die) are thrown. When the dice (or die) are thrown, the back peg is moved the number of moves determined by chart 15 ahead of the front peg to indicate the new playing position.

Players may wish to play a series of games before a winner is declared. In this case, the player having the greatest cumulative weight loss or least cumulative weight gained (if no player has a cumulative weight loss) is the overall winner. Players may also wish to play by partners. In this case, it is the total weight lost or gained by the partners which is considered. Players may also wish to speed up play. This can be accomplished by doubling or tripling the food portions on the "eat" side of chart 15 and correspondingly increasing the time for performing the feat activities on the "feat" side of chart 15. This corresponds to doubling or tripling the number of moves made on the "eat" and "feat" sides of gameboard 1. It should be noted however, that when this is done, the number of playing positions counted to determine the weight gain or loss at the end of a game are not doubled (or tripled). It may also be desired to increase the food portions without correspondingly increasing the times of the heat activities. This tends to make it more difficult to lose weight than gain weight during the weight control game and therefore adds an additional element of reality to the present weight control game. The latter effect may also be produced by utilizing less "feat" cards than "eat" cards rather than utilizing an equal number if "eat" and "feat" cards. Furthermore, while the present weight control game has been described in terms of a gameboard 1 having two series of playing positions, a game board may also be provided having a single series of playing positions. In this case a peg of one color is moved along the single series when "EAT" is spelled out and a peg of another color is moved along the same series when the word "FEAT" is spelled out. At the end of the game, when one of the colored pegs is at the finishing position of the series, the weight gain or loss is calculated by the number of playing positions between the two pegs. In addition while cards and dice have been described as manually manipuable chance selection apparatus, such as a spinning device or the like, may be utilized. These and other modifications to the present weight control game apparatus are intended to be within the scope of the present invention as defined in the following claims.

I claim:

1. A weight control game apparatus comprising:

a gameboard having a plurality of consecutive playing positions;

chance selection means for enabling a player to make a chance selection of one of a variety of foods and exercise activities, each of said foods and exercise activities having a respective number of moves between said playing positions related at least approximately to the caloric value associated with it;

said chance selection means including normally manipulatable means for enabling said player to make a chance selection of one of a plurality of move related symbols, a plurality of eat and feat instruction cards, said feat instruction cards having the letter "F" on one side thereof, said gameboard including a first portion upon which is formed the word "EAT" and a second portion for receiving selected ones of said instruction cards located in relation to said first portion so that the word "FEAT" is spelled out when one of said feat instruction cards is selected by a player; and a chart for enabling said player to relate a selected one of said move related symbols to a respective one of said foods when one of said eat instruction cards has been selected by said player and to a respective one of said exercise activities when one of said feat instruction cards has been selected by said player;

a first playing position marker for indicating movement between said playing positions corresponding to consumption of selected ones of said foods; and a second playing position marker for indicating movement between said playing positions corresponding to the performance of selected ones of said exercise activities;

the relative positions of said first and second playing position markers determining one of weight loss and weight gain and the respective amount thereof.

2. The apparatus recited in claim 1 wherein:

said playing positions are partitioned into a first series of playing positions between starting and finishing playing positions and a second series of playing positions between starting and finishing playing positions;

said first playing position marker indicates moves between playing positions in said first series of playing positions, and said second playing position marker indicates moves between playing positions in said second series of playing positions.

3. The apparatus recited in claim 2 wherein:

said manually manipulatable means includes at least one die.

4. The apparatus recited in claim 3 wherein:

said chance selection means includes two dice; and said chart includes twelve foods and twelve exercice activities associated with the numbers one through twelve, respectively, said foods and exercise activities related to one of a first group of numbers between one and six and a second group of numbers between seven and twelve having only relatively low and relatively high numbers of moves associated with them and said foods and exercise activities related to the other of said first and second groups of numbers having a relatively uniform distribution of number of moves between said relatively low and relatively high numbers of moves associated with them and said foods and exercise activities related to the other of said first and second groups of numbers having a relatively uniform distribution of number of moves between said relatively low and relatively high numbers of moves associated with them.

5. The apparatus recited in claim 2 wherein:

said chart is formed on a portion of said gameboard.

6. The apparatus recited in claim 5 wherein:

said first and second playing position markers includes first and second pegs; and said gameboard has an aperture formed at each of said playing positions to receive said pegs.

7. The apparatus recited in claim 6 wherein:

said first and second pegs each comprise a peg having first and second ends, said first and second ends having substantially the same shape but different colors.

8. The apparatus recited in claim 2 wherein:

said first and second series of playing positions are each arranged along a generally serpentine path.

9. A weight control game apparatus comprising:

a plurality of cards, a group of said cards having the letter "F" formed on the playing side thereof;

manually manipulatable means for enabling a player to make a chance selection of one of a plurality of move related symbols;

a gameboard having a playing surface including a first portion upon which is formed the word 37 EAT"; a second portion for receiving selected ones of said cards, said second portion being located with respect to said first portion so that when selected ones of said cards having the letter "F" formed on the playing side thereof are placed thereon the word "FEAT" is spelled out; a third portion with a first series of consecutive playing positions between starting and finishing positions; a fourth portion with a second series of consecutive playing positions between starting and finishing positions; and a fifth portion with a chart relating said move related symbols to respective foods and exercise activities, each of said foods having a number of moves between playing positions in said third portion corresponding at least approximately to the caloric value associated with it, each of said exercise activities having a number of moves between playing positions in said fourth portion corresponding at least approximately to the caloric value associated with it;

a first marker for identifying movements along said first series determined by said chance selection means and said chart when the word "EAT" is spelled on said gameboard; and a second marker for identifying movements along said second series determined by said chance selection means and said chart when the word "FEAT" remains spelled out on said gameboard.

10. The apparatus recited in claim 9 wherein:

said first and second series of playing positions are each arranged along a generally serpentine path.

11. The apparatus recited in claim 10 wherein:

said first and second markers each comprise a peg; and an aperture is formed at each of said playing positions to receive said pegs.

12. The apparatus recited in claim 11 wherein:

said manually manipuable means includes at least one die.

* * * * *